US006109283A

United States Patent [19]

Burke et al.

[11] Patent Number: 6,109,283

[45] Date of Patent: Aug. 29, 2000

[54] RETRACTABLE ENCLOSURE SYSTEM

[76] Inventors: Robert L. Burke, 205 W. Park Ave., Langhorne, Pa. 19047; Lee Rockafellow, 250 W. Maple Ave., Morrisville, Pa. 19067; Robert Faber, 39 McGilvray Cres, Georgetown, Ontario, Canada, L7G 1L7

[21] Appl. No.: 09/005,457

[22] Filed: Jan. 12, 1998

Related U.S. Application Data

[60] Provisional application No. 60/038,788, Feb. 18, 1997, and provisional application No. 60/053,552, Jul. 18, 1997.

[51] Int. Cl.[7] ..... E04H 15/38

[52] U.S. Cl. ..... 135/129; 52/109

[58] Field of Search ..... 135/129; 52/109, 52/645, 646, 222

[56] References Cited

U.S. PATENT DOCUMENTS

| | | | |
|---|---|---|---|
| 4,262,460 | 4/1981 | Bertin | 52/64 |
| 4,844,109 | 7/1989 | Navarro | 135/103 |
| 5,209,029 | 5/1993 | Foerst | 52/63 |
| 5,224,306 | 7/1993 | Cramer | 52/63 |
| 5,297,368 | 3/1994 | Okada | 52/64 |
| 5,546,972 | 8/1996 | Wardell | 135/129 |

*Primary Examiner*—Beth A. Stephan
*Attorney, Agent, or Firm*—Daniel E. Kramer

[57] ABSTRACT

A retractable enclosure for moveable areas such as barges or trucks and for stationary areas such as swimming pools and areas which must be covered at one time and open at another time such as those housing telescopes, cranes, reactors, etc. The enclosure comprises a multiplicity of rail moveable frames having fabric covered peripheries and constructed to allow the frames to be moved close together at one time whereby the area is uncovered, and to be moved apart or extended to the extent allowed by the attached fabric, whereby the area is covered. A pair of parallel rails is positioned one on each side of the area to be covered. Each frame is supported by a pair of multi-axis trolleys, one trolley positioned at each frame end and engaging one of the rail pair, thereby allowing the frame to move readily. Each trolley has wheels having both vertical and horizontal axes and each rail is shaped to engage the wheels having both axes, thereby providing both weight bearing and horizontal stability perpendicular to the track direction. Means for providing tension on the frames in the extended condition for drawing tight the fabric between the frames are provided.

17 Claims, 8 Drawing Sheets

(sec A–A)

(sec A–A)

RETRACTABLE ENCLOSURE SYSTEM

PRIORITY

Inventors claim priority based on provisional application Ser. No. 60/038,788 filed Feb. 18, 1997 and on provisional application Ser. No. 60/053,552 filed Jul. 18, 1997.

BACKGROUND

1. Field of the Invention

The invention is directed to retractable covering systems for large spaces.

2. Need for the Invention

Open bed trucks and barges are used to allow heavy equipment such as steel or machinery to be readily placed and removed by overhead crane or by fork-lifts or other moving and lifting devices. Most frequently, however, the shipped material, however heavy, is subject to weather, birds, to prying eyes, to frivolous damage or to vandalism. To protect such material, tarpaulins and temporary covers are installed and manually tied in place. The process of installing such covers requires skill and is time consuming. Driver and truck time spent covering a load is time during which the truck is not moving to its destination. It is lost time.

Garbage is generally carried in open trucks from the pick-up point to the land fill or incinerator. Such trucks are loaded through the open top by cranes. State and federal laws require such loads to be covered, both to prevent strewing wind-borne debris during truck motion and to isolate disease bearing materials from distribution by birds, animals and other so-called vectors.

Barges are frequently employed to carry grains and other moisture sensitive materials. After such fungible materials are loaded they must be covered for weather protection. Each hour spent performing the covering task means an hour during which both the barge and its docking or loading area are out of service.

Telescopes and cranes, generators and pumps are mounted to concrete pads. Chemical reactors, chemical settling tanks, engine repair shops; all are subject either to harmful environments or present or require weather or privacy protection yet all demand an option where, for their successful operation or service, they must be open to the sky at one time and otherwise covered at another time.

Yet portable covers must not only provide the required visual and weather protection, they must have substantial physical strength. Such strength is required to bear snow loads and to resist high relative wind velocities. Such high air velocities can occur either from natural air motion such as gales or storms over a stationary cover or from truck or railway car motion at highway speeds. Sufficient strength should even be sufficient to support a service person while inspecting or repairing the cover.

Further, for most efficient exploitation of personnel time and of truck or barge time, and of dock time, covers must be easily installed and removed. That is, they must be installable and removable with minimum person-power, yet in minimum time.

OBJECTIVES

Therefore, it is an objective of the present invention to provide a retractable cover and covering system which is adaptable to installation on trucks, railway cars and barges and on swimming pools or open spaces.

It is a further objective of the invention to provide such a cover and covering system which can be extended to fully cover such spaces or readily retracted, by personnel of low skill and minimum strength.

It is a further objective of the invention to provide such a cover and covering system which when extended, has the physical strength to bear snow loads and high wind velocities without failure.

It is a further objective of the invention to provide such a cover and covering system which when retracted comprises a moveable unit which can be positioned to provide maximum accessibility to the previously covered area.

It is a further objective of the invention to provide such a cover and covering system which can be readily installed on trucks and barges or to cover open areas without special tools or high skilled artisans.

It is a further objective of the invention to provide such a cover and covering system which employs space-spanning unitized structural moving elements which are readily repairable or replaceable by ordinary workmen.

It is further objective to provide such a cover and covering system to provide flexible fabric-like elements for covering and spanning the structural moving elements which are secured to the structural elements yet which can be readily replaced a unit or span at a time without replacing the entire cover.

It is further objective to provide such a cover and covering system where tensioning elements are provided to cause the fabric to become part of the physical structure, when the cover is extended.

It is further objective to provide such a cover and covering system where substantially parallel specially designed but easily constructed rails are provided on each side of the area to be covered.

It is further objective to provide such a cover and covering system where dual axis trolleys are positioned on the rails thereby providing both vertical support and transverse stability.

It is a further objective to provide such trolleys having wheels with horizontal axes for providing vertical support and with vertical axes for providing transverse stability.

It is further objective to provide such a cover and covering system where the space-spanning elements are supported on and move on the trolleys.

It is further objective to provide such a cover and covering system where the cover is securely but removeably attached to the spanning structural elements.

Further objectives will become apparent as the construction and mode of use of the invention is described.

SUMMARY OF THE INVENTION

A retractable covering system for covering and uncovering an area, said system employing two rails formed to resist vertical loads and having a portion formed to resist horizontal torque exerted perpendicular to the rail direction. A first rail is positioned on one side of the area to be covered; a second rail is positioned parallel to the first rail and on the other aide of the area to be covered. Trolleys are provided for engaging the rails. The trolleys have wheels rotating on horizontal axes to bear vertical loads against the rails and have wheels rotating on vertical axes positioned to engage the horizontal torque resisting portion of the rails. Frames having two ends, one end fixed to a trolley mounted on a first rail, the other end fixed to a second trolley mounted on the second rail are provided for bearing a covering fabric.

Flexible fabric is attached to the frames and span the space between the frames. And means for applying tension to the frames when they are extended to cover the area, thereby establishing a structural relationship between the flexible cover and the frames and the trolleys are provided.

DETAILED DESCRIPTION OF THE INVENTION

Figure 1:
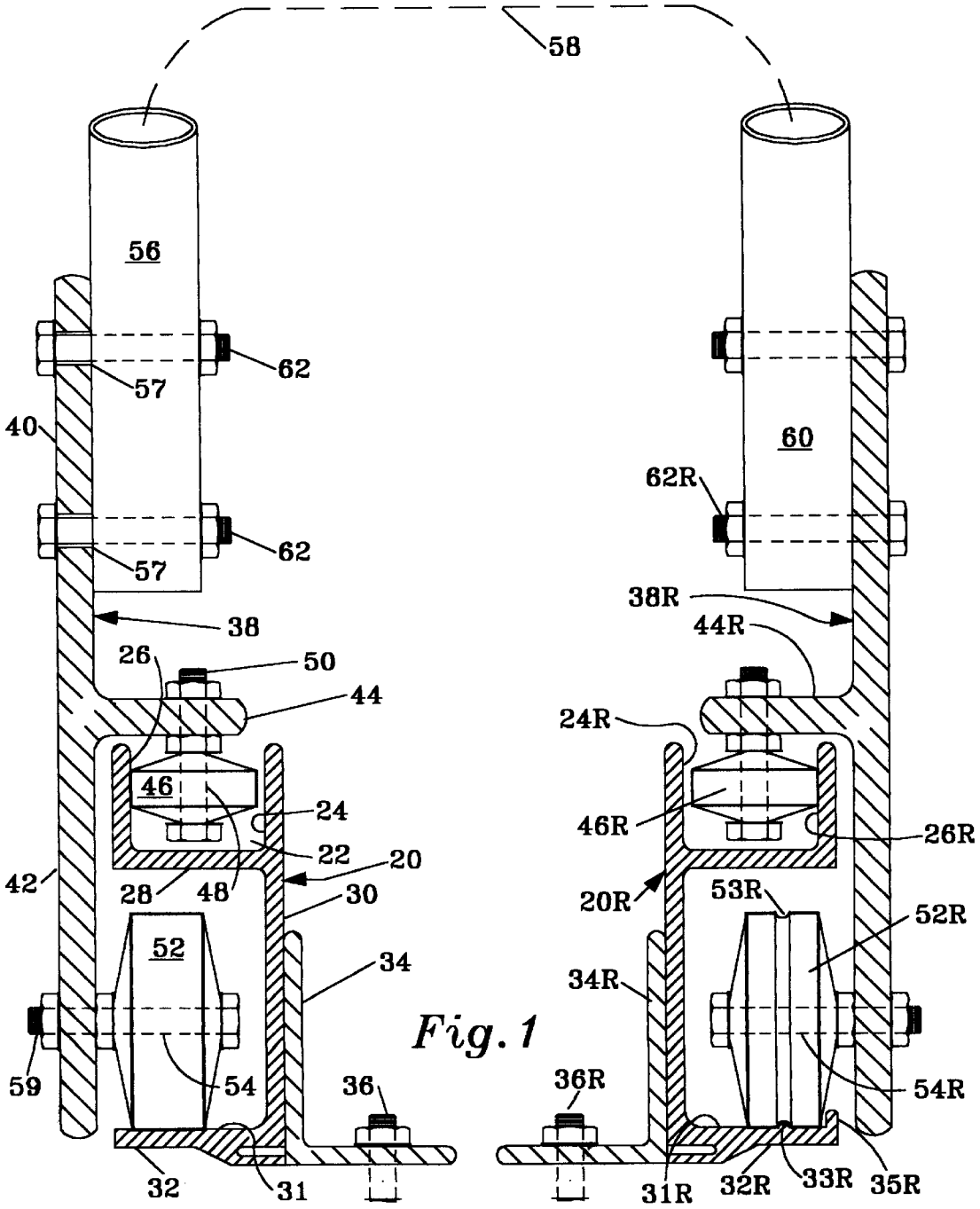
FIG. 1 shows a end section of one version of the invention showing two parallel tracks with a trolley mounted on each track and with an arch or frame connecting the two trolleys.
Figure 2:
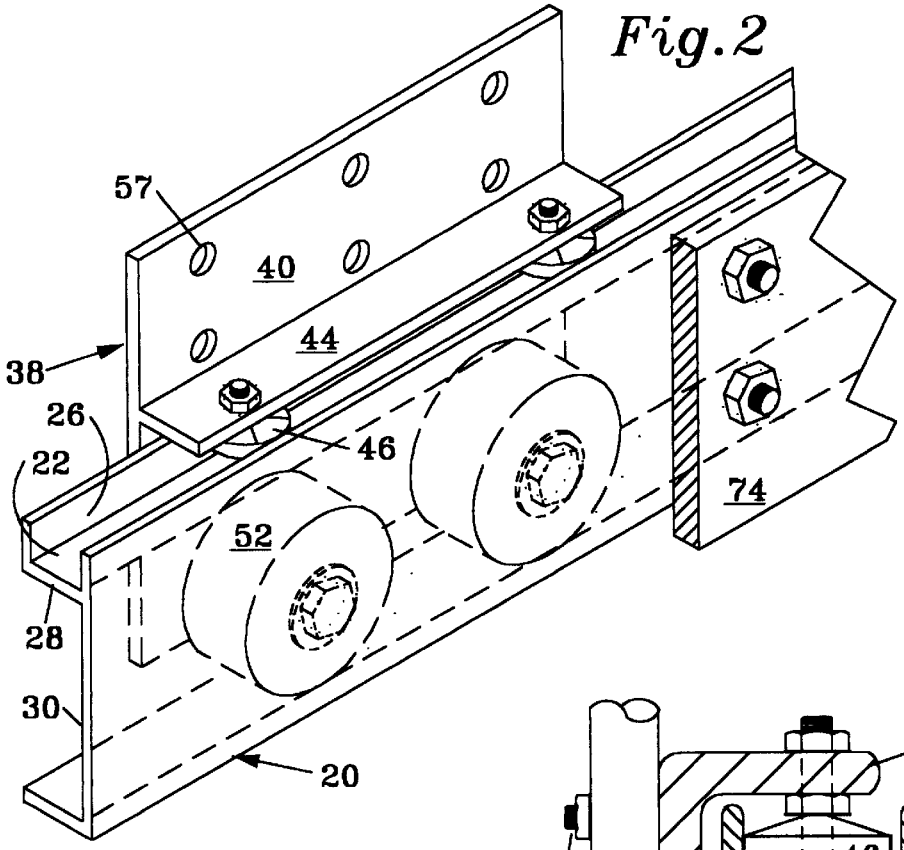
FIG. 2 is an isometric view of one track with mounted trolley and a support member to which the track is mounted.
Figure 4:
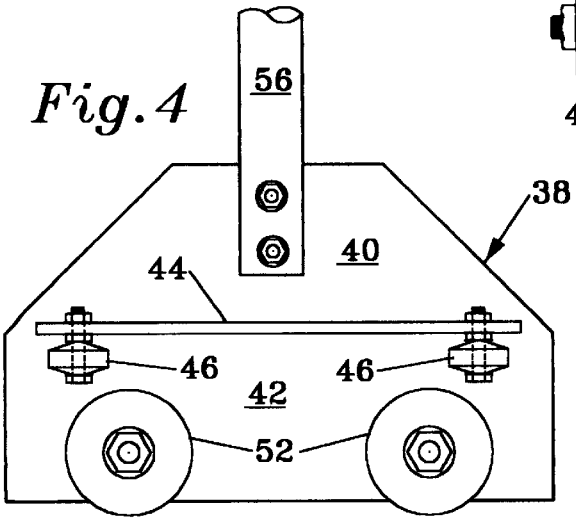
FIG. 4 is a front elevational view of a trolley showing the larger load bearing wheels and the smaller transverse stabilizing wheels.

FIGS. 1,2 and 4 at least, should be examined together. In FIG. 1 there is shown a pair of rails 20 and 20R. In a preferred embodiment of the invention the rail is formed of extruded aluminum, though rails formed with the same characteristics can forged or welded up from steel plate or assembled by welding from stock angles and channels. Though the figures depict the cross-sections as formed of one piece, any construction process, including bolting or gluing many parts together to secure equivalent structures, will meet the requirements of the invention. Further, wherever in the following description reference is made to a numeral designator it is intended that the description apply equally to a designator having the same numeral followed by an "R", should such a designator exist, unless an exception is made.

Each rail has a bottom flange 32 (bottom flange 32R has a different construction which will be addressed later) providing a smooth rolling surface 31 on its upper side. The bottom flange 32 supports at one edge a vertical web 30 which in turn supports an upper channel shaped structure having floor 28, outer wall 26 and inner wall 24. The inner wall 24 as well as the entire upper channel shaped structure may be manufactured or a constructed as part of the web 30 or separate from it. In a preferred embodiment the overall height of rail 20 is 5 inches, the horizontal distance between inner wall 24 and outer wall 26 of upper channel 22 is 1¾ inches and the vertical distance between the rolling surface 31 of flange 32 and the bottom of floor 28 of upper channel 22 is 2 13/16 inches. Since it is intended that the bottom flange and the upper channel 24, 26, 28 bear both vertical and transverse loads, as will be described further, the entire structure must be adequately supported. In FIG. 1 angle 34 provides such support, the angle being bolted via bolts 36 and 36R or otherwise fastened to a support structure (not shown). While means of attachment between mounting angle 34 and rail 20 are not shown, ordinary attachment means such as bolting, welding or the application of industrial adhesives may be employed, taking ordinary engineering care to see that bolts employed to attach rail 20 to its mounting means do not interfere with any function related to ready motion of trolley 38 or free passage of its wheels through and over rail 20.

Figure 3:
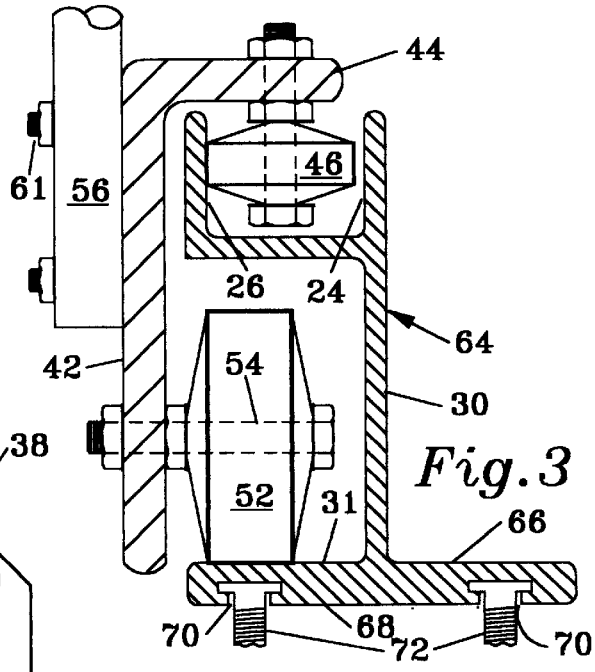
FIG. 3 is an end cross-sectional view of a modified track having slots for mounting and a portion of the trolley in operating position.

In FIG. 3 a full bottom flange 66, 68 is formed integral with vertical web 30. The bottom flange includes a left portion 68, the upper side of which is rolling surface 31 and a right portion 66 with web 30 rising between flanges 66 and 68. In FIG. 3 the bottom of both flange 68 and 66 are provided with slots 70 into which flat headed bolts 72 are engaged to provide secure mounting means to a deck or pad or other support structure (not shown). Instead of mounting slots 70, there may be provided as equivalents, holes positioned in flange 66 and/or in flange 32 and/or in web 30.

Referring again to FIG. 1, there is shown in end cross section a trolley 38 engaging rail 20 and positioned to roll on rail surface 31. Trolley 38 has a substantially vertical upper flange 40, a substantially vertical lower flange 42 and a substantially horizontal transverse flange 44. A front elevational view of trolley 38 is shown at FIG. 4 and an isometric view of trolley 38 positioned within rail 20 is illustrated in FIG. 2. It is intended that the shape of upper flange 40 or the number or arrangement of its mounting holes not be of significance and that, for instance, the upper flange 40 of FIG. 2 and the upper flange 40 of FIG. 4 be equivalent. While the cross-sectional view of trolley 38 of FIG. 1 shows the upper flange 40, the lower flange 42 and the transverse flange 44 to be formed of a single piece of material, it is intended that any convenient means of construction be employed which produces a trolley structure capable of bearing the required loads and providing secure mountings, in substantially the positional relationships shown, for the wheel shafts 54 and the shafts 48 on which rollers/wheels 46 rotate.

Wheels 52 are provided to support the load imposed on the inner rail surface 31 of bottom flange 32 by the combined weight of the trolleys, the frames and the fabric supported by the frames as well as any and all external loads, such as snow, which deposit on the fabric, especially while the frames are extended to cover the intended area. The wheels 52 rotate on shafts 54. Shafts 54 are shown in the form of bolts secured by nuts 59. However, any equivalent construction is satisfactory. The shafts 54 and 48 may be integral with their mounting flanges 42 and 44 or installed in a way to provide an equivalent function. The wheels 52 are formed of Delran nylon with insert bushing, however, wheels of aluminum, steel, or plastic with or without bushings may be selected as equivalent to meet specific environmental or load objectives. In a preferred embodiment, wheels 52 have a 2½ inch diameter.

Figure 6:
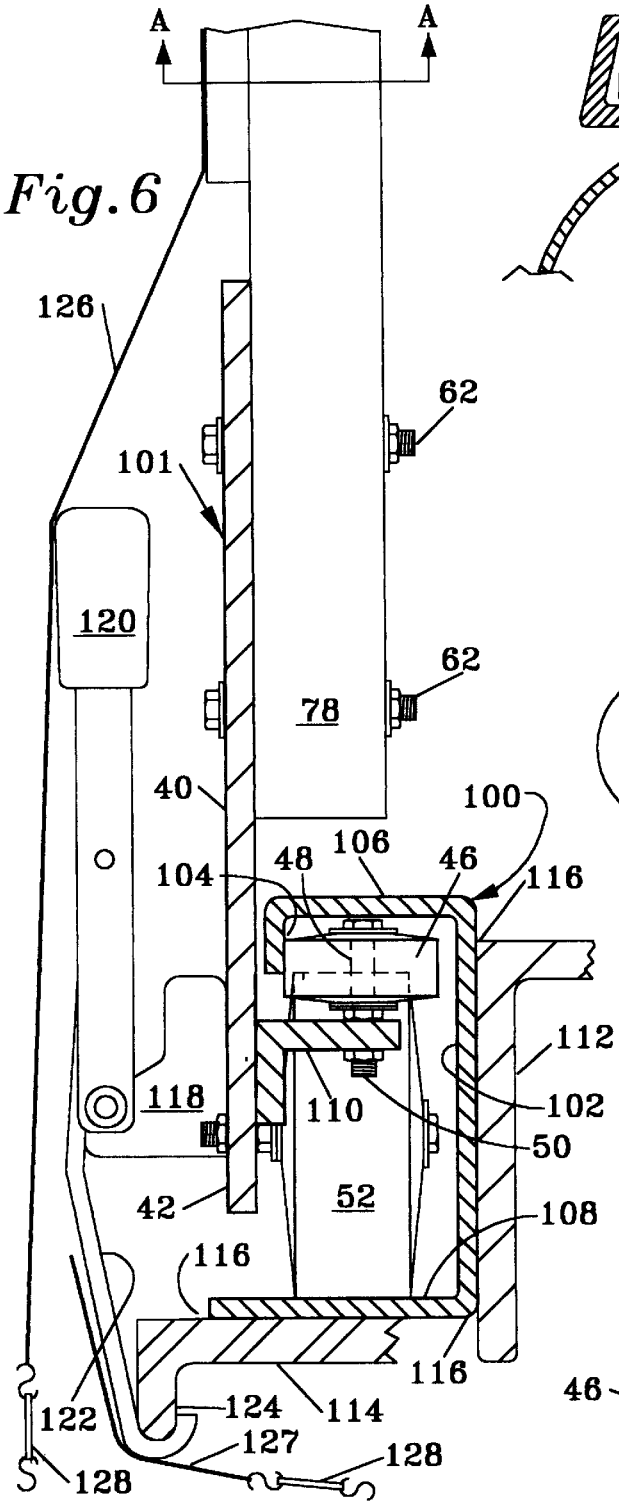
FIG. 6 illustrates a second version of a track exhibiting characteristics of the invention with one frame end attached and with a toggle trolley locking device to provide positive mechanical stability and with an elastic cover tensioner.

Roller 46 is rotatably mounted on substantially vertical shaft 48 formed of the body of bolt 50 which shaft/bolt is in turn mounted or secured to substantially horizontal flange 44 as shown in FIGS. 1 and 6. The assembly of flange 44, shaft 48 and roller 46 is positioned so that roller 46 resides within upper Y channel 22. When trolley 38 is subjected to a transverse torsion or force, roller 46 is caused to contact and thereby restrict the transverse motion of trolley 38 by contacting inner wall 24 or inner wall 26 of the upper channel 22. When such contact takes place roller 46 is caused to rotate and roll along either the inner surface 24 or the outer surface 26 of channel 22.

Mechanisms such low friction belts, glides or lubricated slides are alternate constructions which allow substantially unimpeded motion of a trolley 38 on and with rail 20 and are equivalent to rollers 46 and wheel 52.

While the inner surface of bottom flange 32 of FIG. 1 is substantially planar, the inner surface of flange 32R is provided with a longitudinal ridge 33R intended to mate with and provide guidance and transverse torsional resistance for wheel 52R and trolley 38R by virtue of the groove 53R formed in the cylindrical surface of wheel 52R. In an alternate construction, an upturned lip 35R is provided in the inner surface 31R of bottom flange/rail 32R for the same purpose.

Referring again to FIG. 1 there is shown a rudimentary fabric support frame 56, 58,60 where frame end 56 is secured by bolts 62 mounted though holes 57 (FIG. 2) to trolley upper flange 40 and opposite frame end 60 is similarly bolted to the upper flange 40 of trolley 38R. The frame ends 56, 60 support frame body 58. The frame body is shown as a dotted line only to illustrate its presence.

Figure 5:
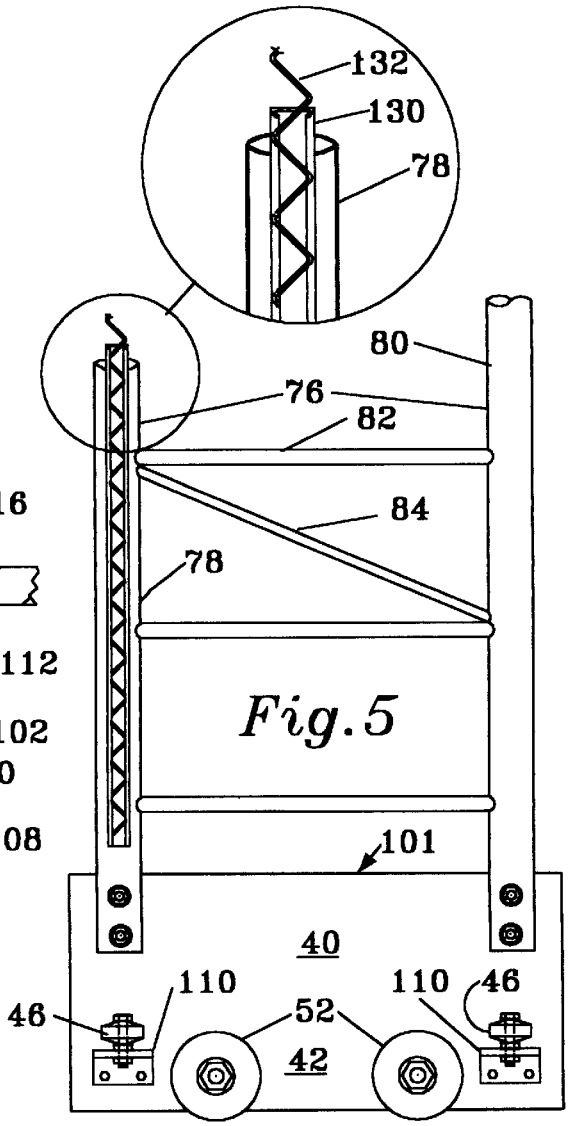
FIG. 5 is a version of the trolley of FIG. 3 having a truss-like frame structure attached to the outer set of trolley mounting holes.

In FIG. 2 the upper flange 40 of trolley 38 is shown having a rectangular shape capable of supporting a variety of frame-end constructions. By contrast in FIG. 4 the upper flange 40 of trolley 38 is illustrated having a trapezoidal shape suitable for supporting a single frame-end 56. A dual frame-end construction is shown in FIG. 5. Specific other constructions for the fabric mounting frames are shown and described elsewhere. In another construction shown in FIG. 3, upper flange 40 is eliminated and the frame-ends are bolted to the lower flange 42 only.

Referring again to FIG. 2 there is shown support or mounting member 74 to which the Y channel 20 is mounted. Member 74 represents any deck, wall or structure to which channel 20 can be securely mounted.

It should be noted that in FIG. 3, flange 44, employed for supporting the vertical shafts on which rollers 46 rotate, occupies substantially the full width of trolley 38. By contrast, in FIGS. 5 and 6, flanges 110 which support the vertical shafts on which rollers 46 rotate is short in order to allow a low position of roller 46.

Referring again to FIG. 5, there is illustrated a front view of a trolley 101 having upper flange 40, lower flange 42 and two transverse flanges 110, each short transverse flange 110 supporting a vertical shaft 48/50 on which roller 46 rotates. Note that in FIG. 5 the shaft 50 on which roller 46 rotates extends upward from the plane of transverse support 110 in contrast with the shaft direction exhibited in FIGS. 1 through 4.

In FIG. 5 dual frame structures 78/80 having substantially identical frame ends 76 are shown bolted to upper flange 40 of the trolley. The dual frame structures are connected together by cross members 82 and 84. The dual frame construction is intended to be employed at the ends of trolley/frame groups, illustrated in FIGS. 16 and 17, to provide increased resistance to flexure while under tension from tensioners to be described.

FIG. 6 illustrates another form of the rail of the invention designated as rail 100. In rail 100 also referred to a C type channel, there is shown in end section a vertical flange 102 an upper transverse flange 106 and a downward projecting outer flange 104. Vertical flange 102 supports or is supported by horizontal lower flange 108 on which load support wheel 52 rolls. Rail 100 is especially well adapted for use in trucks or barges which carry granular material because there is no upward facing channel into which unwanted material can settle, possibly interfering with easy rolling motion of the trolleys. However, ridges 33R or lips 35R (FIG. 1) could be provided to ensure satisfactory tracking of wheel 52.

Two mounting means are shown, demonstrating the utility of this design. Stringer 112, which may be the side of a truck bed or other bed-like structure or coaming 114, which may be the side of a boat or barge are secured to C channel rail 100 by welding at one or more of the weld lines 116. Naturally, the rail may as well be secured to supports by bolts or other convenient means.

Figure 6A:
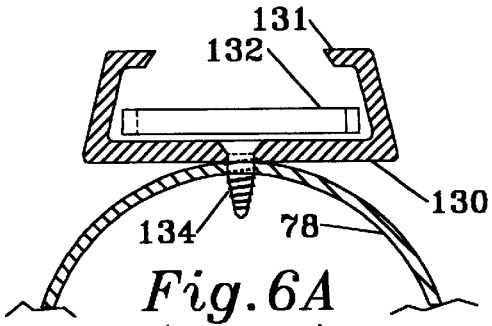
FIG. 6A is a cross-sectional view of a portion of FIG. 6.

Frame end portion 78 is shown bolted to upper trolley flange 101. Just above the top of trolley 101 is shown the lower end of a linear fabric trap 130, a cross section of which is illustrated at section AA, also FIG. 6A. The fabric trap 130 is a channel with turned-in sides, thereby providing a longitudinal receptacle for a zig-zag spring type element 132 whose application can be observed also in FIGS. 8, 9 and 10. A frontal view of the fabric trap 130 mounted on a frame element 78 is shown in FIG. 5. There a enlarged view of a cut-apart end of the frame element 78, the fabric trap 130 and the zig-zag spring is shown.

Reference now should be made to FIGS. 7, 8, 8A, 9 and 10 where the positioning of the various fabric applications and variations are shown with respect to fabric trap 130. Fabric trap 130 could as well be secured to any frame portion such as 56, 60 or 80.

Figure 9:
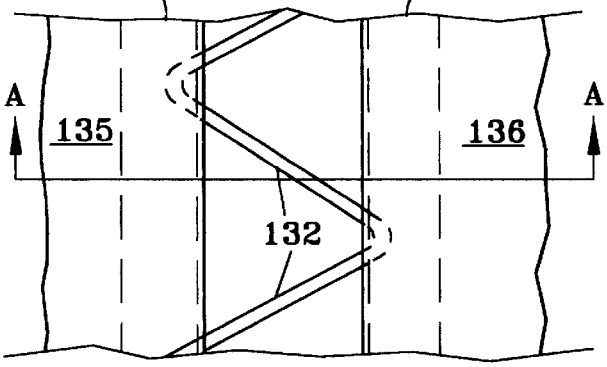
FIG. 9 shows a front view of the construction of FIG. 8 illustrating the position of the zig-zag securing spring.
Figure 8:
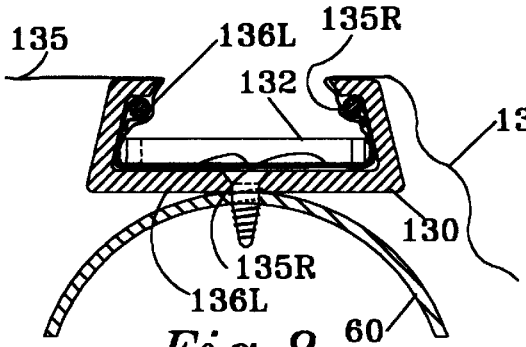
FIGS. 8 and 8A show a pair of end sections of two frame portions in a retracted position with fabric details.
Figure 7:
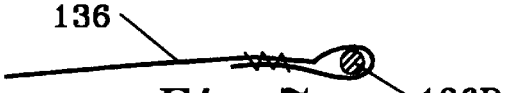
FIG. 7 is an end view of a fabric cover section showing a cord fastened into the section edge.

FIG. 7 shows a hemmed edge of a fabric section 136. Contained within the hemmed edge is rope or cord 136A. This and other similar fabric sections is to be supported by one or more of the frames 58 having tubular members 60 or 78 or 80. In FIG. 8/8A there is illustrated a cross-sectional view of two adjacent frames 60, shown in their retracted positions so that the fabric section 136 between the frames 60 and the fabric traps 130 secured to the adjacent frames 60 is limp. The edges of adjacent fabric sections 135 and 137 are also shown. Each fabric section has a left edge (L) and a right edge (R). Therefore the left edge of fabric section 136 is identified as 136L and the right edge as 136R. Observing now FIG. 8, the right hand portion of fabric portion 135 enters trap 130, traverses the trap interior under zig-zag spring 132, and terminates at 135R. In like fashion, the left edge of centrally positioned fabric section 136 enters trap 130, traverses the trap bottom underneath zig-zag spring 132 and terminates at the left of the spring at 136L. FIG. 9 shows a top view of the trap 130, the zig-zag spring 132 and the two fabric section edges 135R and 136L which are trapped within fabric trap 130.

Figure 11:
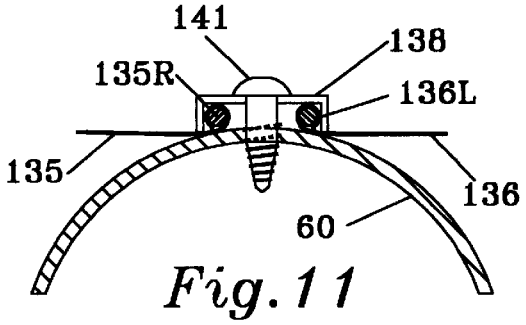
FIG. 11 illustrates another construction for securing fabric section edges of FIG. 7 to a frame.
Figure 8A:
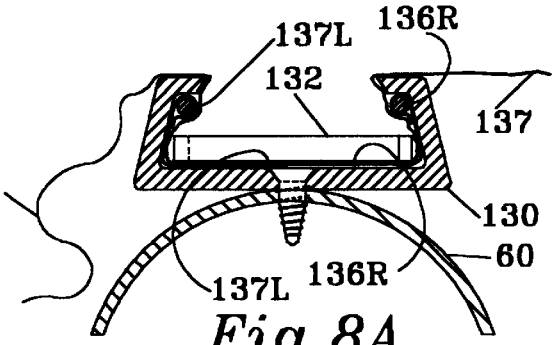

Similarly, at FIG. 8A, there is seen trap 130 within which are secured the edges 136R and 137L of adjacent fabric section 136 and 137. With this construction, it can be seen that simply removing the two zig-zag retaining springs 132 in FIG. 8 and 8A frees the two section edges 135R and 136L and allows a damaged fabric section 136 to be readily removed and replaced. An alternate construction for trapping and securing the hemmed edges of fabric sections is illustrated at FIG. 11 where a channel-like cap 138 secures and confines the two hemmed, cord containing edges 135R and 136L of the two adjacent fabric sections 135 and 136. The cap 138 is secured to the frame 60 by fasteners 141.

Figure 10:
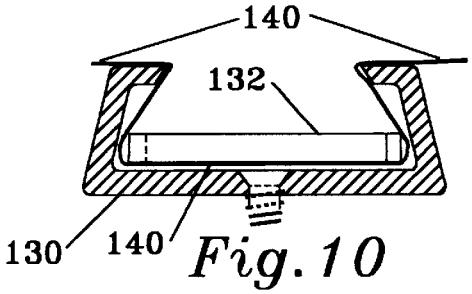
FIG. 10 shows the channel and zig-zag securing element of FIG. 8 employed to secure an intermediate portion of a fabric section.

In FIG. 10 trap 130 and zig-zag spring 132 are employed to secure an intermediate part of a larger fabric section 140 which spans three or more frames and their fabric traps 130. In this application the intermediate portion of fabric section simply is routed into frame 130 and the spring 132 is pressed into the inner channel of the trap 130, thereby securing the intermediate portion of the larger fabric section 140.

Figure 12:
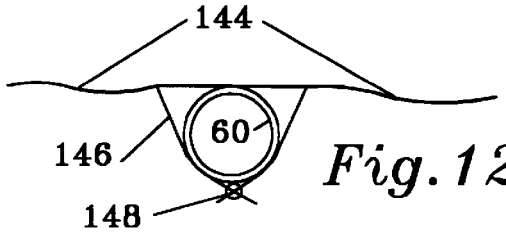
FIG. 12 shows a fabric portion secured to a frame with internal ties.

At FIG. 12 is shown an alternate construction for securing the fabric section 144 to a frame without the use of fabric traps 130 or zig-zag spring 132. In FIG. 12, ties 146 are provided which are sewn or otherwise attached to fabric section 144. These ties 146 are wrapped around the frame 60 and tied or otherwise fastened at 148, thereby securing the fabric to the tubular frame 60.

Returning now to FIG. 6, trolley 101 has upper flange 40, lower flange 42 and transverse flanges 110 on which are upward directed shafts 50 on which rollers 46 are mounted. A frontal view of trolley 101 is provided in FIG. 5. Where the expanded structure is expected to be exposed to extremely high winds or other adverse environments, clamp 118 is bolted to trolley 101. The clamp 118 has a toggle lever 120 and a hook 122. When the trolley 101 is to be moved, the lever 120 is moved to the horizontal position. In this position hook 122 is moved downward and thereby freed from its latched position engaging lip 124 of coaming 114, thereby allowing trolley 101 to freely slide along rail 100 to either a retracted or an extended position. When the trolleys 101 have been moved to their desired positioned, hook 122 is moved to a potential engaging position under lip 124 of coaming 114 and lever 120 is moved to its vertical position, thereby raising hook to a securely engaged position with edge 124 of coaming 114 and locking trolley 101 in place.

In certain application where the extended frame/cover assembly will be subject to high wind velocities, tensioning means 128 are provided for engaging the edges the fabric section 126 and stretching it tightly over the frames. In FIG. 6, elastic tensioners 128 are shown in a position to exert vertical tension on fabric section 126. Where vertical space is unavailable, such as on truck applications, tensioners 128 are shown exerting tensioning force in a more horizontal direction on alternate fabric section 127.

Figure 13:
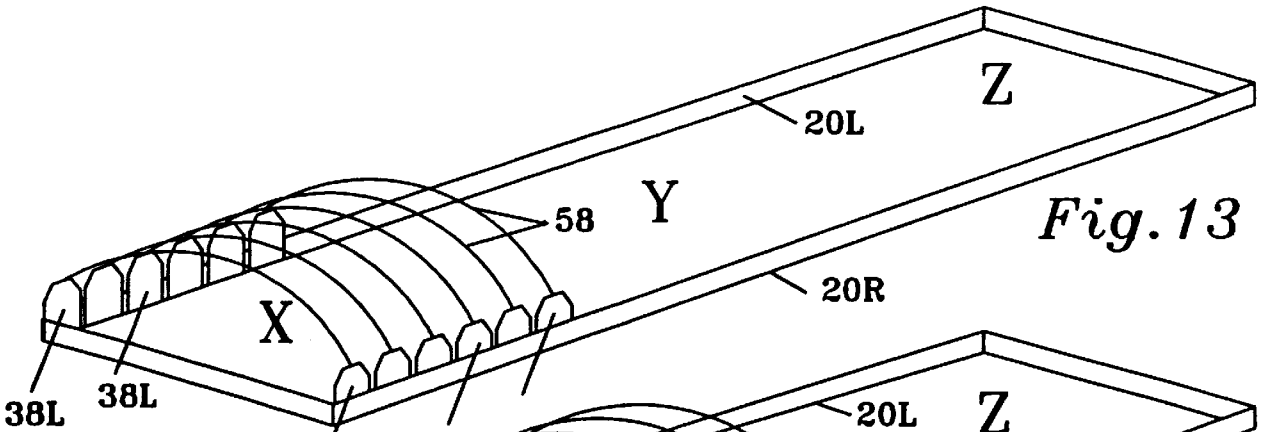
FIG. 13 illustrates a retracted frame/trolley group positioned at one end of a rail.
Figure 14:
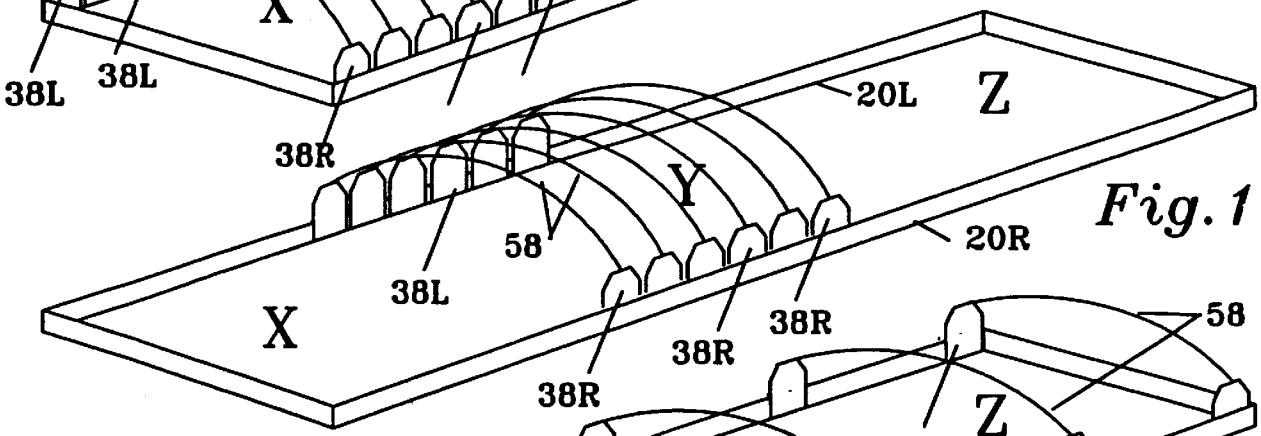
FIG. 14 illustrates a retracted frame/trolley group positioned at a mid-section of a rail.
Figure 15:
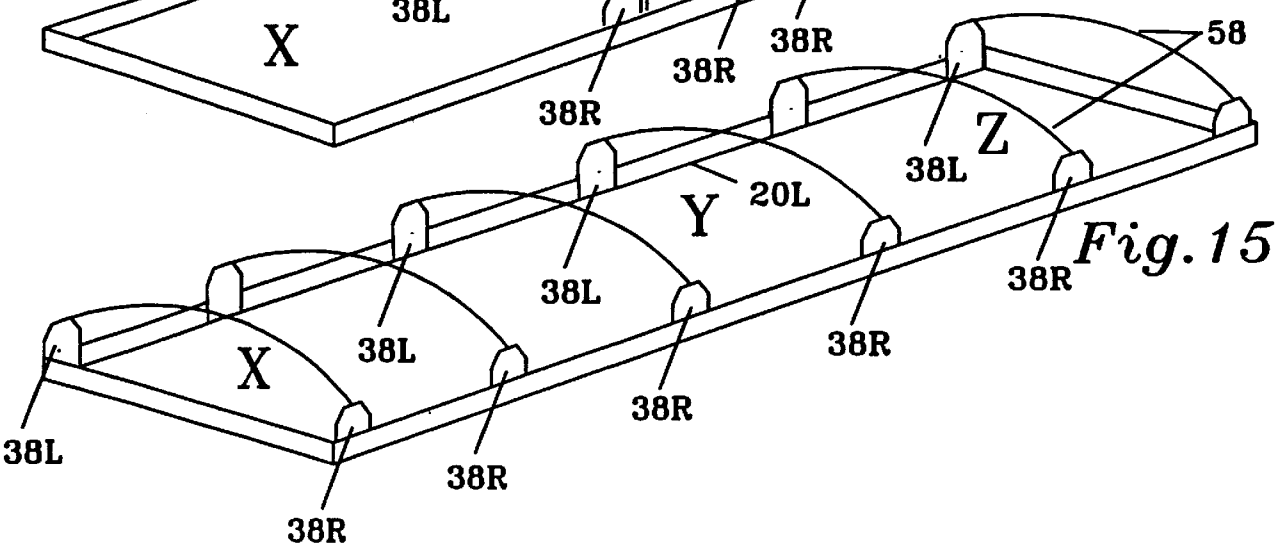
FIG. 15 illustrates a frame trolley group which has been extended to fully cover the space within a rail portion.

FIGS. 13, 14 and 15 show a rudimentary rail base comprising rails 20 and 20R on which a group of trolleys 38 and 38R are positioned, each trolley pair supporting a frame 58 with fabric (not shown) covering and connected to all the frames. Within the area bounded by the rails are areas X, Y and Z. In FIG. 13 the trolleys are retracted, that is moved close to each other, and the group is positioned at the X-end of the rails, thereby causing the frames borne by the trolleys to be equally close and the frame-supported fabric to lay limp between the frames, thereby allowing areas Y and Z to be open and accessible for any function such as loading or unloading product from or to these areas.

In FIG. 14 the trolley/frame/fabric group has been rolled or shifted to central area Y, thereby leaving end areas X and Z uncovered and open for any overhead activity. In FIG. 15 The trolleys have been extended, thereby stretching the covering fabric, (fabric not shown), and causing all the areas X, Y and Z to be fully covered. Of course, the same grouping, sliding retracting and extending function would be as well provided by trolleys 101 rolling on rails 100 and by any combination of frames and fabric covering constructions or techniques. Examples of frame constructions are shown in FIGS. 18 through 22.

Figure 16:
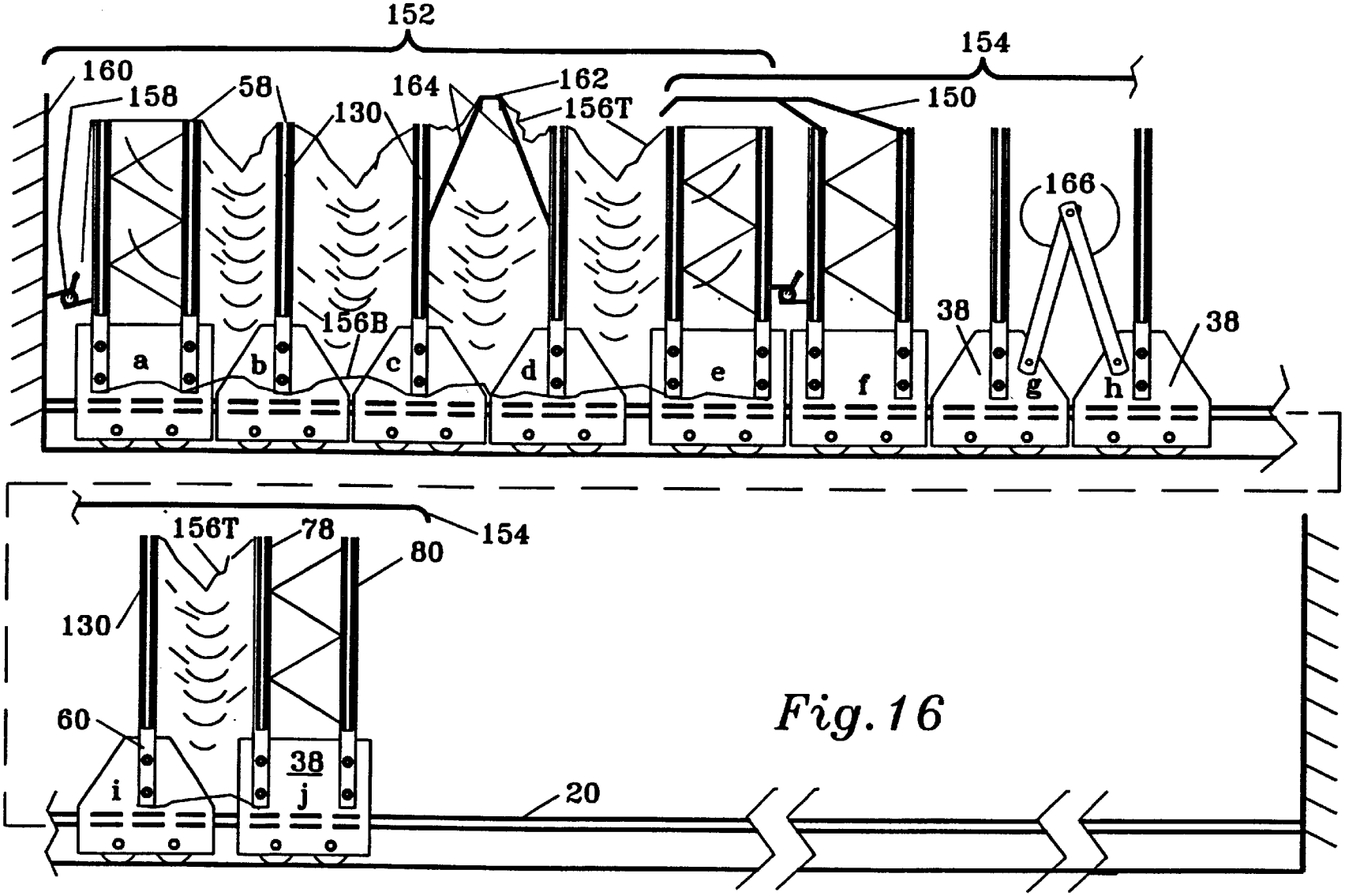
FIG. 16 is split side view of two rail groups in retracted mode showing the limp fabric between adjacent frames and the double frame at the group ends.
Figure 17:
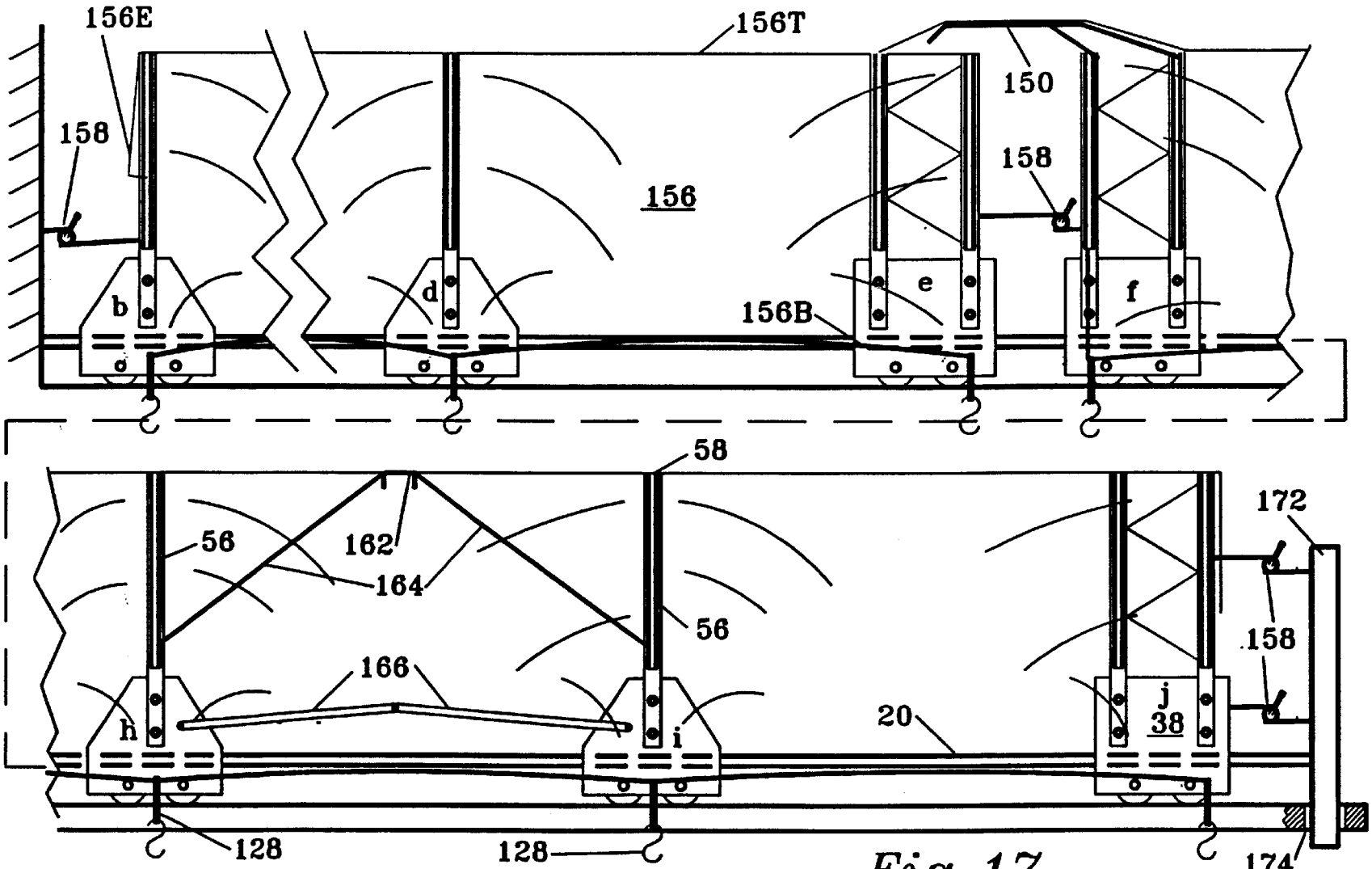
FIG. 17 shows a portion of the rails of FIG. 16 illustrating the trolleys and frames in their extended mode and with tensioners acting to provide fabric tension for stability.
Figure 21:
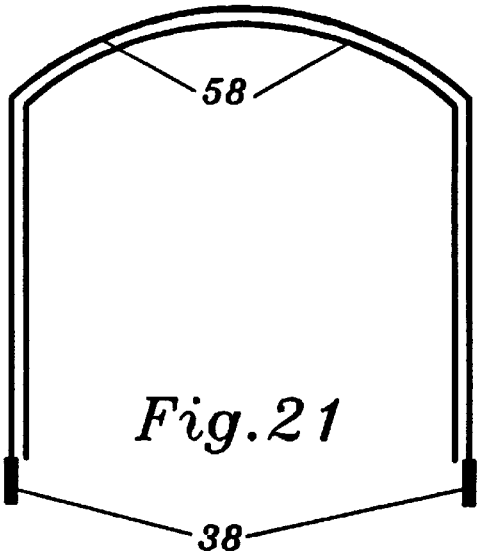
FIGS. 18 through 22 show end views of various frame shapes which best suit various purposes.
Figure 22:
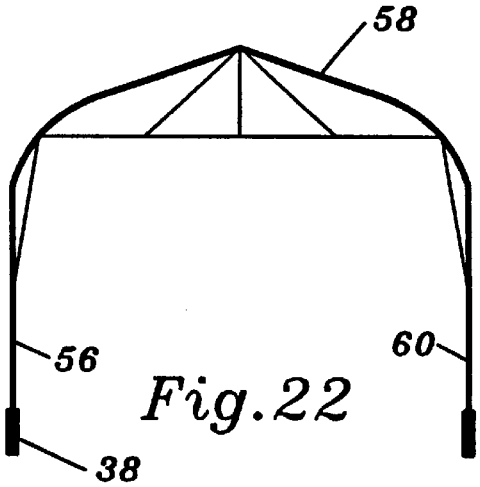
Figure 20:
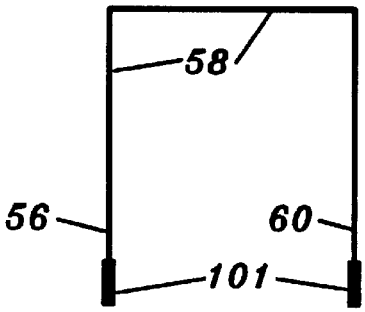
Figure 18:
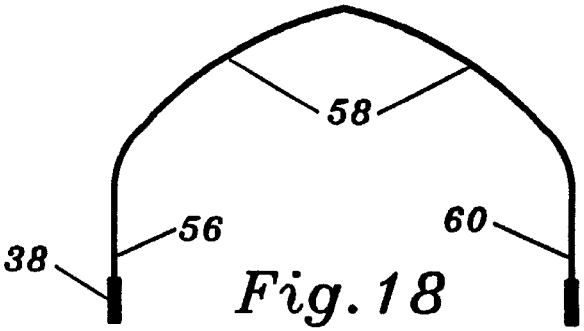
Figure 19:
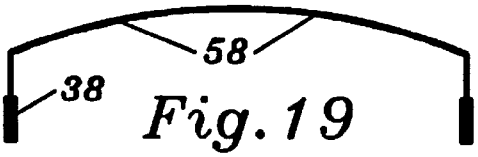

FIGS. 16 and 17 are provided to show in more detail the retracted and extended positions of the trolleys and frames and of tensioning and fabric supporting structures. FIGS. 16 and 17 are side elevations showing only the left trolley of each pair. Cross members 58 (FIG. 1) extends between the uprights 56/60 bolted to each trolley, each trolley thereby supporting the fabric secured in traps 130 which are secured to each frame over its length between the two trolleys which support it.

In FIG. 16 there is shown rail 20 on which are positioned two groups of trolleys/frames. There is shown a first group 152 having left hand trolleys a,b,c,d and e where a and e, both positioned at the ends of the group, have a double frame. The intermediate trolleys in the group have only single frames. For applications subject to high stress conditions or extremely wide spans, double frames would be provided on all trolleys. For low span or low stress applications such as swimming pool covers, single frames would be provided on each trolley. In group 152 the frames are covered with a transparent fabric 156. The top surface of fabric 156 is denoted 156T and the bottom hem of the fabric 156 is denoted as 156B. Where it is desired to employ fewer trolleys and frames yet substantial support between frames must be supplied to support heavy expected loads, cross member 162 is provided having a length substantially equal to the distance between the rails. Cross member 162 extends between two adjacent uprights 56 on the left trolleys and two corresponding adjacent uprights 60 mounted on the right trolleys. Cross member 162 is supported by arms 164, each pivoted from an adjacent trolley, c and d or uprights 56 rising from those trolleys. In the retracted position cross member 162 resides well above the top of the adjacent cross members 58. However, when, as shown in FIG. 17, the trolleys are extended to fully stretch the covering fabric 156, the cross member 162 assumes a position substantially level with and between the tops of the two adjacent frames.

Returning to FIG. 16, there is shown trolley group 154 residing on the same rail set 20 as trolley group 152. Within this trolley group fabric is shown only between the frames supported by intermediate trolley i and end trolley j. There is shown between trolley g and trolley h a toggle pair 166 pivoted to the two adjacent trolleys whose purpose is to provide internal fabric tension without the use of ratchet tensioners 158. The combined length of the two arms 166 is established to be slightly greater than the width of the fabric section residing between the two frames bolted to the two adjacent trolleys g and h. Therefore, when the trolleys are in the extended position as shown in FIG. 17, the toggles 166 stretch and thereby tension the fabric fastened between the adjacent frames.

Referring again to FIG. 17, there is shown trolleys from both the 152 and the 154 group in the extended positions.

Naturally, fewer trolleys are shown. Trolley b is shown as an end-trolley having only a single frame. An end cover 156E is shown. Though the end cover 156E is shown not extending to the level of the rails, in other constructions the end cover extends to rail level and is provided with zippers or hook/loop linear fasteners to allow entry.

Tensioners 158 are shown whose function it is to pull on the end trolleys and frames so that the fabric between adjacent frames is taut, thereby providing substantially greater resistance to destabilizing forces such as those arising from wind, snow, motion etc. Elastic tensioners 128 are shown providing a downward force at the bottom edges of the fabric.

FIGS. 18 through 22 illustrate some of the wide variety of frame shapes which can be utilized to support the inter-frame fabric sections. In general the upper and cross frame members between and supported by the upright members are designated 58 and the vertical members rising from and attached to and supported by the trolleys 38 are numbered 56 and 60.

As employed herein, the terms fabric and fabric-like apply to any flexible, sheet-like or cloth-like material such as employed for tent construction, umbrellas, tarpaulins, swimming pool covers, rain coats and the like, whether or not there is any woven or fiber or thread-like material embodied within the fabric.

From the foregoing description, it can be seen that the present invention comprises an advanced system for providing secure covering and weather protection for an area while allowing convenient and rapid means for retracting and uncovering the covered area. It will be appreciated by those skilled in the art that changes could be made to the embodiments described in the foregoing description without departing from the broad inventive concepts thereof. It is understood, therefore, that this disclosure is not limited to the particular embodiment or embodiments disclosed, but is intended to cover all modifications and equivalents thereof which are within the scope and spirit of the invention as defined by the appended claims.

We claim:

1. A rail-trolley combination for supporting and facilitating the movement of frames borne by the trolleys, said combination comprising;

a rail having a load bearing lower part and a transverse torque resisting upper part, a trolley having lower wheel means for rolling on and transmitting load to the rail lower part and upper roller means for applying transverse torque to the rail upper part.

2. A rail-trolley combination as recited in claim 1 further providing that the rail torque resisting upper part comprises a channel having vertical walls and an open side and the upper trolley roller means comprises at least one roller positioned within the channel.

3. A retractable covering system for a substantially rectangular area, the area having two sides and two ends, substantially parallel first and second rails positioned along said sides, the area residing between the rails, fabric-like means for covering the area, at least two frame means for spanning the area and for supporting the fabric-like means, each frame means having a contour and two ends, at least two adjacent independent rail mounted trolley means positioned on each of said first and second rails for moving along the rails and for engaging and supporting an end of each frame means, whereby the frame means are positioned substantially parallel to each other and are moveable toward each other at a first time and away from each other at a second time in accord with corresponding movement of the trolley means, means for securing the fabric-like means to the contours of the frame means, whereby movement of adjacent trolley means toward each other on the rails at the first time causes the area to be uncovered and movement of the adjacent trolley means away from each other on the rails at the second time causes the area to be covered, and further providing toggle means positioned between frames for applying a separating force to the frames at the second time thereby applying tension to the fabric-like means secured to the frames.

4. A retractable covering system as recited in claim 3 further providing that the toggle means are positioned between adjacent frames.

5. A retractable covering system for a substantially rectangular area, the area having two sides and two ends, substantially parallel first and second rails positioned along said sides, the area residing between the rails, fabric-like means for covering the area, at least two frame means for spanning the area and for supporting the fabric-like means, each frame means having a contour and two ends, at least two adjacent independent rail mounted trolley means positioned on each of said first and second rails for moving along the rails and for engaging and supporting an end of each frame means, whereby the frame means are positioned substantially parallel to each other and are moveable toward each other at one time and away from each other at a second time in accord with corresponding movement of the trolley means, means for securing the fabric-like means to the contours of the frame means, whereby movement of adjacent trolley means toward each other on the rails at the first time causes the area to be uncovered and movement of the adjacent trolley means away from each other on the rails at the second time causes the area to be covered, and further providing that each rail comprises means for supporting the weight of the trolleys and the frames and for allowing motion of the trolleys along the rails and for resisting torque exerted by the trolleys in a direction transverse to the rails, and further providing that the rail supporting and torque resisting means comprises a rail construction which, in cross-section, includes a lower flange having an upper rolling surface, a substantially vertical web arising from the lower flange, and a U-shaped channel having substantially vertical sides, a closed side joining the vertical sides and an open side, means for securing said channel to the web in a position substantially parallel to the rolling surface and above it.

6. A covering system as recited in claim 5 further providing that the U-shaped channel is positioned with its open side facing upward, away from the rolling surface.

7. A covering system as recited in claim 5, further providing that the U-shaped channel is positioned with its open side facing downward, toward the rolling surface.

8. A covering system as recited in claim 5, further providing that each trolley comprises a web positioned generally collinear with a rail, the web having a top and a bottom, at least two horizontal shafts supported by and positioned near the bottom of the web, load bearing wheels rotatably positioned on said shafts, said shafts being positioned to permit the wheels to engage and be supported by said rail rolling surface, and at least one vertical shaft, means for supporting the vertical shaft from the web, and a roller rotatably mounted on the vertical shaft, said roller being positioned within the channel.

9. A covering system as recited in claim 8 where the roller is positioned within a U-shaped channel having its open side facing away from the rolling surface.

10. A covering system as defined in claim 8, where the roller is positioned within a U-shaped channel having its open side facing toward the rolling surface.

11. A covering system as recited in claim 5 further providing that the lower flange includes up-turned lip means for preventing the trolley from rolling off the rolling surface.

12. A retractable covering system for a substantially rectangular area, the area having two sides and two ends, substantially parallel first and second rails positioned along said sides, the area residing between the rails, fabric-like means for covering the area, at least two frame means for spanning the area and for supporting the fabric-like means, said frame means having a contour and two ends, at least two adjacent independent rail mounted trolley means positioned on each rail for moving along the rails and for engaging and supporting and end of each frame means whereby the frame means are positioned substantially parallel to each other and are moveable toward each other at a first time and away from each other at a second time in accord with corresponding movement of the trolley means, means for securing the fabric-like means to the contour of the frame means, whereby movement of adjacent trolley means toward each other on the rails at the first time causes the area to be uncovered and movement of the adjacent trolley means away from each other on the rails at the second time causes the area to be covered, and further providing that the means for securing the fabric-like means to the frame contour comprises a partly closed channel having an interior, said channel being positioned substantially collinear with the contour of the frame means and attached to it, the fabric-like means traversing the interior of said partly closed channel, and resilient means for securing the fabric-like means within the channel interior.

13. A retractable covering system as recited in claim 12 where the resilient means comprises a zig-zag spring positioned within the channel interior, thereby securing the fabric-like means within the channel interior.

14. A rail-trolley combination for supporting and facilitating the movement of frames borne by the trolleys, said combination comprising;

a rail having a load bearing lower part and a transverse torque resisting upper part, a trolley having lower wheel means for rolling on and transmitting load to the rail lower part and upper roller means for applying transverse torque to the rail upper part, and further providing that the rail torque resisting upper part comprises a channel having vertical walls and an open side and the upper trolley roller means comprises at least one roller positioned within the channel, and further providing that the channel open side faces in an direction selected from the group consisting of upward and downward.

15. A rail trolley combination as recited in claim 14, further providing means integral with the rail lower part for preventing the said trolley wheel means from rolling off said lower part.

16. A rail-trolley combination as recited in claim 15 where the anti-rolling off means comprises a longitudinal ridge formed into the rail load bearing part, the groove engaging a groove in a trolley wheel.

17. A rail-trolley combination as described in claim 15 where the anti-rolling off means comprises a lip formed in an edge of the rail load bearing part.

* * * * *